United States Patent [19]

Jandeska et al.

[11] Patent Number: 4,849,164

[45] Date of Patent: Jul. 18, 1989

[54] METHOD OF PRODUCING IRON POWDER ARTICLE

[75] Inventors: William F. Jandeska, Rochester; Vadim Rezhets, West Bloomfield; Carlo Ligotti, Romeo, all of Mich.

[73] Assignee: General Motors Corporation, Detroit, Mich.

[21] Appl. No.: 161,518

[22] Filed: Feb. 29, 1988

[51] Int. Cl.[4] ..... B22F 1/00

[52] U.S. Cl. ..... 419/11; 75/243; 75/244; 75/246; 419/12; 419/45; 419/47

[58] Field of Search ..... 75/244, 243, 246; 419/11, 12, 45, 47

[56] References Cited

U.S. PATENT DOCUMENTS 4,537,323 8/1985 Ditchek et al. ..... 419/12
4,618,473 10/1986 Jandeska, Jr. ..... 419/11
4,678,510 7/1987 Jandeska, Jr. et al. ..... 75/244
4,724,000 2/1988 Larson et al. ..... 75/244

*Primary Examiner*—Stephen J. Lechert, Jr.
*Attorney, Agent, or Firm*—Douglas D. Fekete

[57] ABSTRACT

A sintering aid is disclosed for use in a powder metallurgical method for manufacturing an iron alloy article by compacting and sintering a predominantly iron powder mixture comprising carbon powder and a boron-containing additive, such as nickel boride. The sintering aid comprises an oxygen getter to inhibit boron oxidation that, if formed, is believed to retard carbon diffusion. The sintering aid also preferably includes a second constituent to produce, in combination with the getter, a melting point suitable for forming a transient liquid phase during the early stages of sintering. Preferred sintering aids include intermetallic iron titanium compounds, intermetallic ferro-vanadium compound and intermetallic nickel magnesium compound.

8 Claims, No Drawings

METHOD OF PRODUCING IRON POWDER ARTICLE

BACKGROUND OF THE INVENTION

This invention relates to an iron alloy article formed by compacting and sintering a predominantly iron powder mixture that comprises carbon powder and a boron-containing additive. More particularly, this invention relates to a sintering aid added to the powder mixture to promote carbon diffusion, particularly within interior regions of a large compact, and thereby produce a more uniform matrix microstructure.

U.S. Pat. No. 4,618,473, issued to Jandeska in 1986, describes an iron alloy article produced by compacting and sintering a powder mixture composed predominantly of iron powder and containing a carbon powder and a nickel boron powder, preferably of intermetallic nickel boride compound. During sintering, the iron is diffusion bonded into an integral structure. Carbon diffuses into the iron to form a mainly pearlitic or martensitic product microstructure. Nickel and boron also diffuse into the iron, but nickel diffusion is localized in pore regions to form, upon cooling, retained austenite phase that enhances product toughness. Preferably, powdered copper is added for increased hardness and dimensional control.

It has also been found that, at suitable concentrations, boron that diffuses into the iron combines with carbon to produce dispersed, hard borocementite particles that improve wear resistance. U.S. Pat. No. 4,678,510, issued to Jandeska in 1987, describes sintering a predominantly iron powder compact containing carbon powder and boron-containing additive to produce the desired hard particles. The boron additive preferably includes both nickel boride powder and iron boride powder. In addition to forming the borocementite particles, carbon is also required to produce the desired martensitic or pearlitic matrix.

In the methods described in both patents, sintering is preferably carried out in a vacuum to eliminate oxygen that would otherwise react with boron. Boron oxide compound does not suitably relinquish boron to the iron in the desired manner.

In sintering iron powder articles having large cross sections, it has been found that sintering times adequate to bond the iron into a cohesive structure produce a desired martensitic or pearlitic microstructure in exterior regions, but that interior regions contain undiffused carbon particles and carbide-free ferrite grains. Ferrite is relatively soft and reduces product strength. We have found that the desired matrix microstructure may be formed in interior regions by extending the sintering time, for example, by up to a factor of 10, but at a substantial cost penalty. Since more uniform carburization is found in comparable compacts that do not include the metal boride additive, this delayed interior carburization is believed attributable to the presence of boron.

Therefore, it is an object of this invention to provide an improved method for forming a powder iron article comprising carbon and a boron-containing additive, which promotes carbon diffusion within interior compact regions during sintering that is comparable to carbon diffusion within exterior regions, despite the presence of boron, to produce a more uniform microstructure throughout the compact without a required extension of the sintering time.

More particularly, it is an object of this invention to provide an improved method for compacting and sintering a predominantly iron powder mixture comprising carbon powder and boron-containing additive, which method includes addition of a sintering aid to the powder mixture to promote carbon diffusion within interior regions of the compact and thereby to produce a more uniform matrix microstructure composed predominantly of martensite or pearlite. The sintering aid also promotes boron diffusion and in one aspect of this invention enhances formation of hard borocementite particles dispersed throughout the product, including within both interior and exterior regions.

SUMMARY OF THE INVENTION

In accordance with a preferred embodiment, these and other objects are obtained by compacting and sintering a predominantly iron powder mixture comprising a carbon powder and a metal boron additive, and further comprises a sintering agent containing an oxygen getter. In general, preferred mixtures are composed mainly of low-carbon iron powder and comprise carbon powder and nickel boride powder, optionally in combination with iron boride powder. The mixture may also contain copper powder. The particular composition depends upon the desired product microstructure. For products comprising retained austenite and described in U.S. Pat. No. 4,618,473, incorporated herein by reference, a preferred powder mixture comprises between about 0.7 and 1.0 weight percent graphite powder, between about 2 and 3 weight percent metallic copper powder, and nickel boride powder in an amount sufficient to produce a nickel content between about 0.5 and 1.0 weight percent, and the balance iron powder. For an iron product comprising borocementite particles and described in U.S. Pat. No. 4,678,510, incorporated herein by reference, a preferred composition comprises between about 1 and 2 weight percent carbon powder, between 2 and 3 weight percent copper powder, between about 0.8 and 3.1 weight percent nickel boride powder, iron boride powder in an amount sufficient to increase the total boron concentration to between 0.15 and 1.2 weight percent, and the balance iron powder.

In accordance with this invention, the powder mixture further includes a sintering aid comprising an oxygen-reactive metallic constituent that acts as a getter. Preferred oxygen getters include titanium, vanadium, magnesium and rare earth elements, such as neodymium. The sintering aid is preferably formulated to form a transient liquid phase during sintering that increases reactivity of the getter. This is accomplished by a second constituent effective in combination with the getter to reduce the melting point to within the intended sintering range. The second constituent is preferably iron, or another metal such as nickel or copper, desired in the product structure. Accordingly, preferred aids of this invention include powders composed of alloys or compounds of iron and titanium, iron and vanadium, and nickel and magnesium. In addition, the sintering aid may further comprise boron for diffusion into the iron structure during sintering.

The mixture including the sintering aid is compacted and sintered at a temperature and for a time sufficient to diffusion bond the iron powder into an integral structure. During sintering, carbon from the carbon particles diffuses into the iron matrix to form, upon cooling, a matrix microstructure composed predominantly of martensite or pearlite. Boron also diffuses into the iron.

Sintering is preferably carried out in a vacuum. Despite evacuation, trace amounts of oxygen may remain within interior regions of the compact. While the role of the sintering aid is not fully understood, it is believed that, in the absence of the sintering aid, such trace oxygen reacts with boron to form boron oxide, $B_2O_3$, that inhibits carbon diffusion. An oxygen getter added in accordance with this invention is believed to react with the trace oxygen to inhibit boron oxidation and thereby prevent boron oxide interference with carbon diffusion.

In any event, it is found that the addition of an oxygen getter sintering aid in accordance with this invention promotes carbon diffusion within internal regions comparable to within external regions. The sintered product exhibits a more uniform iron matrix microstructure composed predominantly of martensite or pearlite, with significantly reduced carbide-free ferrite grains, particularly within interior regions. This is accomplished without extending the sintering time required to produce the product article.

DETAILED DESCRIPTION OF THE INVENTION

In the following examples of preferred embodiments of this invention, iron alloy articles comprising dispersed hard borocementite particles were formed by compacting and sintering a powder mixture that includes a base composition and a sintering aid containing an oxygen getter.

The base composition comprises, by weight, about 94.1 parts plain iron powder, about 1.4 parts graphite powder, about 2.0 parts copper powder, about 0.8 parts nickel boride powder, about 1.7 parts iron boride powder, and about 0.5 parts commercial die pressing lubricant. The iron powder was a low-carbon commercial grade material having a maximum carbon content of 0.01 weight percent and sized to −60 mesh. The graphite powder was a commercial synthetic powder available from Joseph Dixon Crucible Company, New Jersey, under the trade designation KS-2, and having particle sizes between about 2 and 5 microns. The metallic copper powder was a commercial purity material sized to −140 mesh. The nickel boride powder was an arc-melted material composed substantially of intermetallic compound NiB and containing about 14.8 weight percent boron, the balance nickel and impurities. The iron boride consisted substantially of intermetallic compound FeB and contained about 16 weight percent boron, the balance iron and impurities. To produce the powder, commercially available nickel boride and iron boride were fragmented and sized to −400 mesh. The die pressing lubricant was obtained from Glyco, Inc., Connecticut, under the trade designation Glycolube PM 100.

EXAMPLE 1

In this example, about 1.0 parts by weight of iron titanium alloy powder. Commercially obtained alloy containing about 72 weight percent titanium was ground to −400 mesh to form the powder.

In formulating the powder mixture, all powders except graphite powder and the lubricant were premixed using a drum-tumbler type mixer. The graphite and the lubricant are then added. Fine mists of spindle oil may be sprayed into the mixer to reduce graphite powder segregation and thereby obtain a more uniform mixture.

The mixture was compacted in a suitable die to produce a flat annular compact having an outer diameter of about 57.15 millimeters, an inner diameter of about 22.2 millimeters and a thickness of about 12.7 millimeters. The green compact had a density of about 7.0 grams per cubic centimeter, corresponding to about 92 percent of the theoretical density. The green compact was heated within a vacuum furnace in two steps. The furnace was initially evacuated to a pressure less than $10^{-3}$ torr and heated to about 500° C. for a time, approximately one-half hour, sufficient to vaporize the lubricant. After the lubricant was vaporized, as indicated by stabilization of the pressure, the furnace temperature was increased to 1120° C. and held for about 60 minutes for sintering. The sintered compact was quenched to room temperature while exposed to convective dry nitrogen gas.

The sintered product exhibited a microstructure comprising borocementite particles dispersed within a fine pearlite matrix. More particularly, it was found that the microstructure within the case region adjacent the surface was essentially identical to the microstructure within the core region. Because of the superior wear resistance produced by the hard borocementite particles within the strong iron alloy matrix, the annular product was particularly well suited as a machinable gear blank.

COMPARATIVE EXAMPLE 1

For comparison, a second compact was manufactured from the base composition, without the addition of an oxygen-getter sintering aid. The base mixture was compacted and sintered following the procedure in Example 1. It was found that the case region of the sintered product consisted of borocementite particles dispersed in a fine pearlite matrix comparable to the product microstructure in Example 1. However, the core region was composed of mainly ferrite grains and contained undissolved carbon particles and large iron boride particles, with minor amounts of grain boundary cementite. Thus, the getter-free product did not exhibit the uniform microstructure found in the Example 1 product.

EXAMPLE 2

In this and the following examples, the product iron articles were transverse rupture test bars having a length of 30 millimeters and a square cross-section that is about 12.5 millimeters wide. The bar thickness was approximately equal to the thickness of the annular product in Example 1.

In this example, a test bar was formed from a powder blend composed of the base composition plus the iron titanium powder described in Example 1, but the iron titanium addition was increased to three parts by weight. The powdered constituents were blended following the procedure in Example 1 and loaded into a suitably shaped die cavity. The powder was compacted under a load of approximately 620 MPa to form a green compact having a density of about 7.0 grams per cubic centimeter. The green compact was sintered following the procedure of Example 1, except that the sintering time at 1120° C. was shortened to 20 minutes.

The product article exhibited a uniform microstructure comprising hard borocementite particles dispersed within a pearlite matrix and appeared comparable to the microstructure produced in Example 1. The microstructure in the case regions was essentially indistinguishable from that in the core regions.

EXAMPLE 3

An iron alloy bar was produced following the procedure of Example 2 from a blend of the base composition plus three parts by weight of an iron titanium powder composed mainly of intermetallic $Fe_2Ti$ compound. The $Fe_2Ti$ powder contained 32 weight percent titanium and was ground to −400 mesh. The blend was prepared, compacted and sintered following the procedure of Example 2. The product exhibited a uniform microstructure in both case and core regions that appeared substantially similar to the microstructure formed in Example 1.

EXAMPLE 4

An iron alloy bar was formed from a blend of the base composition plus one part by weight copper manganese powder. The copper manganese powder was composed predominantly of intermetallic CuMn compound and contained about 42 percent manganese. The compound was prepared by rapid solidification spin casting and ground to −400 mesh. The blend was prepared, compacted and sintered following the procedure of Example 2. The case microstructure appeared substantially identical to that formed in Example 1. The core matrix was composed predominantly of martensite, but still contained about 30 percent carbide-free ferrite grains. The core included dispersed, hard borocementite particles, but also exhibited discontinuous carbide ribbons and large, blocky iron boride particles. In comparison to the core microstructure formed by the getter-free base composition as in the Comparative Example, the increased martensite and borocementite phases indicated an improvement in carbon diffusion. However, in view of the significant residual ferrite phase, the manganese additive was not considered as effective as the iron titanium additives. It is believed that an increased addition of the copper manganese powder may have further enhanced carbon diffusion to reduce the core ferrite grain content.

EXAMPLE 5

An iron alloy bar was produced from a blend of the base composition plus about four parts of magnesium nickel powder. The magnesium nickel powder was composed mainly of intermetallic $MgNi_2$ compound and contained about 15 weight percent magnesium. Commercially available magnesium nickel was ground to −400 mesh to produce the powder. The blend was prepared, compacted and sintered following the procedure in Example 2. In the case and core regions, the microstructure exhibited hard borocementite particles distributed in a predominantly pearlite matrix. However, the hard particles were segregated. The microstructure also evidenced a discontinuous carbide phase at grain boundaries. The nickel-magnesium addition also increased the content of retained austenite phase to about 18 percent, as compared to less than 5 percent for products formed from the base alloy.

EXAMPLE 6

An iron alloy bar was produced from a blend of the base composition plus about 2.5 parts by weight iron vanadium powder. The iron vanadium powder was composed mainly of intermetallic FeV compound and contained about 50 weight percent vanadium. Commercially available iron vanadium compound was ground to −400 mesh to form the powder. The blend was prepared, compacted and sintered as in Example 2. The product exhibited a uniform microstructure in both case and core regions characterized by hard borocementite particles dispersed within a pearlite matrix. The microstructure was comparable to that formed in Example 1 using the iron titanium addition, except that the average size of the dispersed hard particles appeared smaller.

EXAMPLE 7

An iron alloy bar was produced from a powder mixture composed of, by weight, 90.7 parts low carbon iron powder, 1.2 parts graphite powder, 2.0 parts copper powder, 2.8 parts nickel boride powder, 3.3 parts iron-neodymium-boron alloy powder and 0.5 parts die pressing lubricant. The iron-neodymium-boron alloy powder was composed of, by weight, about 30 percent neodymium, 1 percent boron and the balance substantially iron.

The powders were blended, compacted and sintered as in Example 2. The product exhibited a uniform matrix microstructure in both case and core regions characterized by hard borocementite particles dispersed in a pearlite matrix, but exhibited increased retained austenite due to the increased nickel addition.

In the examples, a sintered structure was formed from a powder mixture composed mainly of low-carbon iron powder and containing (1) carbon powder, (2) a liquating boron additive and (3) a liquating sintering aid to promote carbon diffusion into the iron despite the boron. By liquating is meant that the agent forms a liquid phase in contact with iron at sintering temperatures. In contrast, carbon does not liquefy at sintering temperatures, but rather dissolves into the iron, which is austenitic at the sintering temperature and thus has a high carbon solubility, by solid state diffusion. The boron additive in the examples comprises nickel boride powder and iron boride powder. As the compact is heated for sintering, the nickel boride compound melts to form a liquid phase that wets iron surfaces within the compact. The iron boride, in turn, dissolves into the liquid phase. The liquid phase increases the activity, as well as increasing iron contact, of nickel and boron to enhance diffusion into the skeleton. As nickel and, more particularly, boron diffuse into the iron, the liquid phase becomes depleted and eventually dissipates.

In the absence of boron, carbon readily diffuses into the iron during sintering, both within case and core regions of the compact. Even with the boron addition, carbon readily diffuses within small compacts and even within case regions of larger compacts. However, carbon diffusion within core regions of larger compacts is noticeably retarded. Boron oxide $B_2O_3$ has been detected in core regions that exhibit retarded carbon diffusion. This is attributed to trace amounts of oxygen that are not exhausted from interior compact pores into the ambient vacuum, perhaps because the oxygen is not released until heating. Even if boron oxide is similarly formed in the pores near the surface, boron oxide is vaporized at sintering temperatures, and may be exhausted before inhibiting carbon diffusion.

In any event, sintering aids in accordance with this invention are selected to contain a constituent having an oxidation potential suitably low to react preferentially with oxygen and thereby inhibit formation of boron oxide. By inhibiting boron oxidation, not only is increased boron available for diffusion, but more significantly to this invention, carbon diffusion is enhanced. As used herein, standard free energy of oxide formation is reported per mole oxygen at 1400° K., approximately the preferred sintering temperature. A standard free energy of oxide formation less than −130 kcal/mole is believed suitable to enhance carbon diffusion. Preferred getters have a standard free energy less than −152 kcal/mole, which is the standard free energy of $B_2O_3$. Vanadium exhibits a standard free energy of −145 kcal/mole for $V_2O_3$, but is believed, under oxygen-deficient conditions found within the evacuated compact during sintering, to form VO which has a standard free energy less than boron oxide. The standard free energy for titanium dioxide, $TiO_2$, is about −157 kcal/mole, but is even less for the oxygen-deficient compound, TiO. As shown in the examples, preferred getters include vanadium, titanium and magnesium. Rare earth elements, such as neodymium, also have preferred low standard free energies of oxide formation. Manganese has a standard free energy of oxide formation of about −136 kcal/mole and enhanced carbon diffusion in the example, but was not as effective, although greater manganese additions may further promote carbon diffusion. In general, it is also desired that the getter have minimal adverse effect upon the product. In the examples, titanium produced a microstructure substantially similar in appearance to a microstructure formed in a case region of a sintered compact formed without the sintering aid, and is thus more preferred. FeTi and $Fe_2Ti$ appear equally effective for comparable titanium additions.

The sintering aid also preferably includes one or more other constituents to form a low melting powder suitable to produce a liquid phase during early stages of sintering. A liquid phase is desired to enhance the activity of the getter. A preferred second constituent is iron. Nickel is also suitable, but may increase the retained austenite phase, which may or may not be desirable, depending upon the intended use of the product. Copper is also a suitable constituent, particularly in compacts comprising metallic copper additions. Also, all or part of the boron addition may be combined with the getter in a single additive powder.

The amount of gettering agent effective to enhance carbon diffusion is believed dependent upon the amount of oxygen trapped within the compact interior during sintering which, in turn, may be related to compact size, vacuum efficiency and oxygen impurity in the constituent metal powder. In general, it is desired to minimize the gettering agent to reduce cost and avoid effect upon the principal structure metallurgy. For iron titanium alloy powder in Examples 1 and 2, additions of between about 0.5 and 3.0 weight percent based upon product weight, corresponding to a product of titanium content between about 0.4 and 2.2 weight percent, have been found to promote interior carbon diffusion, with a range between about 0.7 and 1.4 weight percent being preferred. Comparable ranges for other suitable getters may be determined based upon corresponding atomic proportions.

In grinding a powder of the desired sintering aid, care is taken to avoid heating the agent in the presence of oxygen. Intermetallic compounds are typically brittle and may be readily ground into a fine powder. It has been found that heat generated during grinding may prematurely oxidize the aid, thereby reducing the effectiveness thereof.

In the examples, the base composition contained nickel boride and iron boride and was formulated to produce an iron alloy product comprising dispersed hard borocementite particles distributed in a pearlite matrix, that is, a product such as described in U.S. Pat. No. 4,678,510. However, this invention is believed to be equally applicable to other formulations that include additions of diffusable carbon and boron additives. For example, a sintering aid in accordance with this invention may be added to formulations prepared in accordance with U.S. Pat. No. 4,618,473 to avoid oxidation of boron and thereby enhance carbon diffusion. Also, in the examples, the sintered product was slow cooled to produce a predominantly pearlite matrix. Alternately, the sintered product may be rapidly quenched, for example by oil immersion, to produce a predominantly martensite matrix.

Suitable iron powder for use in forming an article in accordance with this invention is composed of iron or an iron alloy that does not have significant carbon or boron content. In an alternate embodiment, iron powder is composed of an iron alloy such as iron-base nickel-molybdenum alloy to improve mechanical properties of the product. Carbon is blended into the powder mixture in an amount sufficient to produce a hypereutectoid matrix. A small portion of the carbon, on the order of 0.03 weight percent, is lost during vacuum sintering. In those embodiments wherein a product comprising hard borocementite particles is desired, additional carbon is added for forming the particles. In general, a carbon addition between about 1 and 2 percent, preferably between about 1.2 and 1.8 weight percent, is desired to form the hard particles.

In addition to carbon, powder mixtures for use with this invention include a liquating boron-containing additive. Powders formed of intermetallic metal boride compounds are preferred. Suitable boron sources produce a transient liquid phase for a short time during the early stages of sintering, but rapidly dissipates upon diffusion of the boron into the iron matrix, and include nickel boride, cobalt boride and manganese boride. In those embodiments wherein it is desired to form hard borocementite particles, boron is added in an amount suitable to produce a boron concentration in the sintered product between about 0.15 and 1.2 weight percent. A combination of nickel boride with iron boride is preferred to avoid formation of excessive nickel-stabilized retained austenite phase in those embodiments involving borocementite particles.

Although not essential to the practice of this invention, a copper addition is preferred to increased matrix hardness and to compensate for iron shrinkage during sintering. Copper assists in driving carbon and boron from about pores to concentrate within interior regions in forming the hard particles where desired. This is attributed to a relatively low boron and carbon affinity for copper. Copper concentrations greater than about 4 weight percent tend to produce excessive liquid formation during sintering that causes unwanted product distortion. In general, a copper addition between about 2 and 3 weight percent is preferred.

In the described embodiment, the green compact is sintered within a vacuum furnace. Sintering may be suitably carried out by other processes that minimize constituent oxidation, for example, using a reducing atmosphere, a cracked ammonia atmosphere, a hydrogen atmosphere or a dry inert gas atmosphere. Atmospheres may be enriched by addition of a hydrocarbon source such as methanol or propane, if necessary, to reduce carbon loss. In embodiments comprising a preferred copper addition, sintering is suitably carried out at a temperature above 1083° C., the melting point of copper, so as to produce the desired copper liquid phase. In general, higher temperatures are desired to enhance diffusion bonding. However, practical problems are posed in handling compacts at temperatures above 1150° C. A sintering temperature between 1110° C. and 1120° C. is preferred. It is desired that the time for sintering be sufficient for iron diffusion bonding and for diffusing the several elements into the iron lattice. For sintering temperatures within the preferred range, sintering times between about 15 and 35 minutes produce satisfactory structures.

While this invention has been described in terms of certain embodiments thereof, it is not intended that it be limited to the above description, but rather only to the extent set forth in the claims that follow.

The embodiments of the invention in which an exclusive property or privilege is claimed are defined as follows:

1. In a method for manufacturing an iron alloy article by compacting and sintering a powder mixture composed predominantly of iron powder and comprising carbon powder and a boron-containing powder, said sintering being carried out at an elevated temperature to bond the mixture into an integral iron-base structure and diffusing the carbon and the boron into the structure, the improvement comprising including in said mixture prior to compaction a sintering aid comprising a metallic constituent preferentially reactive with oxygen relative to boron, said sintering aid being formulated to form a transient liquid phase during sintering, to inhibit boron oxidation and thereby to promote diffusion of said carbon and boron into the iron structure.

2. In a method for manufacturing an iron alloy article by compacting and sintering a powder mixture composed predominantly of iron powder and comprising carbon powder and a boron-containing powder, said sintering being carried out at an elevated temperature to bond the mixture into an integral iron-base structure and diffusing the carbon and the boron into the structure, the improvement comprising adding to said mixture prior to compaction a sintering aid suitable for forming a transient liquid phase during sintering and comprising a preferentially oxygen-reactive metallic constituent having a standard free energy of oxide formation at sintering temperatures less than the standard free energy of oxide formation of boron, such that said constituent reacts with oxygen within said compact during sintering to inhibit oxidation of said boron and thereby to promote diffusion of carbon and boron into the iron structure.

3. In a method for manufacturing an iron alloy article by compacting and sintering a powder mixture composed predominantly of iron powder and comprising carbon powder and a boron-containing powder, said sintering being carried out at an elevated temperature to bond the mixture into an integral iron-base structure and diffusing the carbon and the boron into the structure, the improvement comprising including in the powder mixture prior to compaction a powder comprising a preferentially oxygen-reactive constituent selected from the group consisting of titanium, vanadium, magnesium and rare earth elements and a melting point depressant constituent suitable in combination with said oxygen-reactive constituent for reducing the melting point of said sintering aid to form a transient liquid phase during sintering, such that during sintering the oxygen-reactive constituent inhibits boron oxidation and promotes diffusion of carbon and boron into the iron structure.

4. The method according to claim 3 wherein the melting point depressant constituent is selected from the group consisting of iron, copper and nickel.

5. The method according to claim 4 wherein the sintering aid comprises iron titanium alloy.

6. The method according to claim 4 wherein the sintering aid is composed of intermetallic ferro-vanadium compound.

7. The method according to claim 4 wherein the sintering aid is composed of intermetallic nickel magnesium compound.

8. The method according to claim 4 wherein the sintering aid further comprises boron.

* * * * *